US009414670B2

(12) United States Patent
Bo

(10) Patent No.: US 9,414,670 B2
(45) Date of Patent: Aug. 16, 2016

(54) COLLAPSIBLE TABLE HAVING INTERLOCKING ASSEMBLY

(71) Applicant: Boka Import Export, Inc., Torrance, CA (US)

(72) Inventor: Hong Bo, Jinhua (CN)

(73) Assignee: Boka Import Export, Inc., Torrance, CA (US)

( * ) Notice: Subject to any disclaimer, the term of this patent is extended or adjusted under 35 U.S.C. 154(b) by 0 days.

(21) Appl. No.: 14/568,530

(22) Filed: Dec. 12, 2014

(65) Prior Publication Data

US 2016/0166055 A1 Jun. 16, 2016

(51) Int. Cl.
*A47B 23/00* (2006.01)
*A47B 5/04* (2006.01)
*A47B 3/00* (2006.01)

(52) U.S. Cl.
CPC .. *A47B 5/04* (2013.01); *A47B 3/002* (2013.01)

(58) Field of Classification Search
CPC ..... A47B 31/04; A47B 5/00; A47B 5/04; A47B 46/005; A47B 3/002; D06F 81/06; D06F 81/02
USPC ..... 108/42, 47, 48, 46, 152, 143, 102, 134; 248/240.4, 240.3, 235
See application file for complete search history.

(56) References Cited

U.S. PATENT DOCUMENTS 1,580,289 A * 4/1926 Cummings ..... 108/134
2,038,143 A * 4/1936 Swanson ..... 248/240.4
2,284,003 A * 5/1942 Luppert ..... 248/240.4
2,483,899 A * 10/1949 Grasso et al. ..... 108/134
3,113,533 A * 12/1963 Snow ..... 108/134
4,068,601 A * 1/1978 Marsh et al. ..... 108/134
4,844,398 A * 7/1989 Konkle ..... 248/240.4
4,927,107 A * 5/1990 Mateo Maria ..... 248/240.4
6,705,235 B1 * 3/2004 Gerutto ..... 108/47
7,210,414 B1 * 5/2007 Barone ..... 108/42
7,464,652 B2 * 12/2008 Hauck ..... 108/48
8,267,017 B1 * 9/2012 Michael et al. ..... 108/42
8,607,777 B2 * 12/2013 Ducate et al. ..... 126/30

FOREIGN PATENT DOCUMENTS

CN 203210349 9/2013

* cited by examiner

*Primary Examiner* — Jose V Chen
(74) *Attorney, Agent, or Firm* — Tsircou Law, PC

(57) ABSTRACT

A collapsible table assembly is provided that allows a platform table to be easily stowed parallel to a wall when not in use. The collapsible table assembly having a hinged interlocking assembly comprising support arms coupled to a table platform. The support arms are capable of guiding the platform from a stowed position, to a deployed position. The hinged interlocking assembly further comprises a first and a second pliant member disposed within the guide groove. The pliant members act to restrict certain directional movement of the hinge axis pin as it travels through the guide groove while the table platform is transitioned from the stowed position to the deployed position, and vice-versa. The pliant members prevent the table platform from collapsing inadvertently, by only allowing the hinge axis pin to travel in one direction throughout the guide groove while transitioning between stowed and deployed.

20 Claims, 7 Drawing Sheets

COLLAPSIBLE TABLE HAVING INTERLOCKING ASSEMBLY

FIELD OF THE INVENTION

The present invention relates generally to collapsible tables and, more particularly, to wall-mounted tables having interlocking assembly.

BACKGROUND OF THE INVENTION

Space is often a constraint when it comes to setting up a work area. It is beneficial to have a work table that can be stowed when not in use. Various collapsible work tables are known in the art; however, there remains a need for an improved collapsible work table that is easier to operate, is more compact when stowed, and has improved safety features to prevent inadvertent collapsing of the work surface when deploying or stowing the work table.

Many of the collapsible work tables require the user to get down under the table and manually lock, or unlock, the support arms in order to deploy or collapse the work table. The main safety issues with other collapsible work tables come into play when the user is collapsing the work table to the stowed position. If the user has to reach down and unlock the support arms, there is a risk of the user getting his hand or finger pinched in the support arm. Other risks are associated with the weight of the work table causing the arms to collapse as soon as the user unlocks the support arms. Even if the collapsible work table was arranged to collapse the table when the user manipulated the table in a certain way (i.e., lift the table), there would be substantial risk of inadvertent releasing of the support arms. This could lead to user injury or damage to equipment resting on the work table.

Other variations of collapsible work tables are attached to a wall support, which prevents the table from being stowed parallel to the wall, or requires the user to manually detach the table from the wall when collapsing the table into the stowed position. The nature of the support arms in these scenarios prevent the table from being stowed completely parallel with the wall. Problems arise when the table is angled downward, yet not parallel with the wall. Items can be snagged on the side of the table, or users could easily hit the edge of the table with their foot or shin and hurt themselves.

Therefore, there remains a considerable need for a collapsible work table that can easily, and safely, be stowed away or deployed by a user in such a way as to minimize its profile when in storage and prevent inadvertent release of the support arms when deployed.

SUMMARY OF THE INVENTION

Briefly, and in general terms, the present invention is directed towards a collapsible table having a hinged interlocking assembly comprising support arms coupled to a table platform. The support arms are capable of guiding the platform from a stowed position, to a deployed position, and vice versa, in such a way as to minimize its profile when in storage and prevent inadvertent release of the support arms when deployed.

More specifically, in an exemplary embodiment, the collapsible table has a platform having a proximal end and a distal end, mounted to a wall support structure for rotation between a deployed position and a stowed position. The table further has a hinged support arm comprised of a first segment, having a top end and a bottom end, and a second segment having a top end and a bottom end. The first and second segments are pivotally coupled via a hinge assembly disposed in an intermediate region of the hinged support arm. The top end of the first segment is attached to the underside of the platform at a distance spaced from the proximal end of the platform. The bottom end of the second segment is coupled to the wall structure below the platform, and the top end of the second segment is coupled to the bottom end of the first segment.

In a detailed aspect of an exemplary embodiment, the hinge assembly pivotably couples the first segment and the second segment together via a hinge axis pin. The hinge axis pin is integrated with the second segment at the top end of the second segment, and retains the first segment to the second segment via a guide groove disposed at the bottom end of the first segment. The guide groove confines the hinge axis pin within a prescribed path using a guide member and a stopper groove.

In another detailed aspect of an exemplary embodiment, a first pliant member and a second pliant member are disposed within the guide groove and act to restrict certain directional movement of the hinge axis pin as it travels through the guide groove, as the platform is moved between the stowed and deployed positions.

In another detailed aspect of an exemplary embodiment, the first pliant member is anchored within the guide groove wall, and it extends across the guide groove to the opposite wall, with the intermediary portion of the first pliant member abutting the head of the guide member. The second pliant member is anchored within the guide groove wall and positioned to prevent the hinge axis pin from retracing its path if the hinge axis pin is inadvertently dislodged from the stopper groove after the platform has been deployed. The second pliant member is disposed proximate to the stopper groove and extends, at an angle, towards the base of the head of the guide member.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1A:
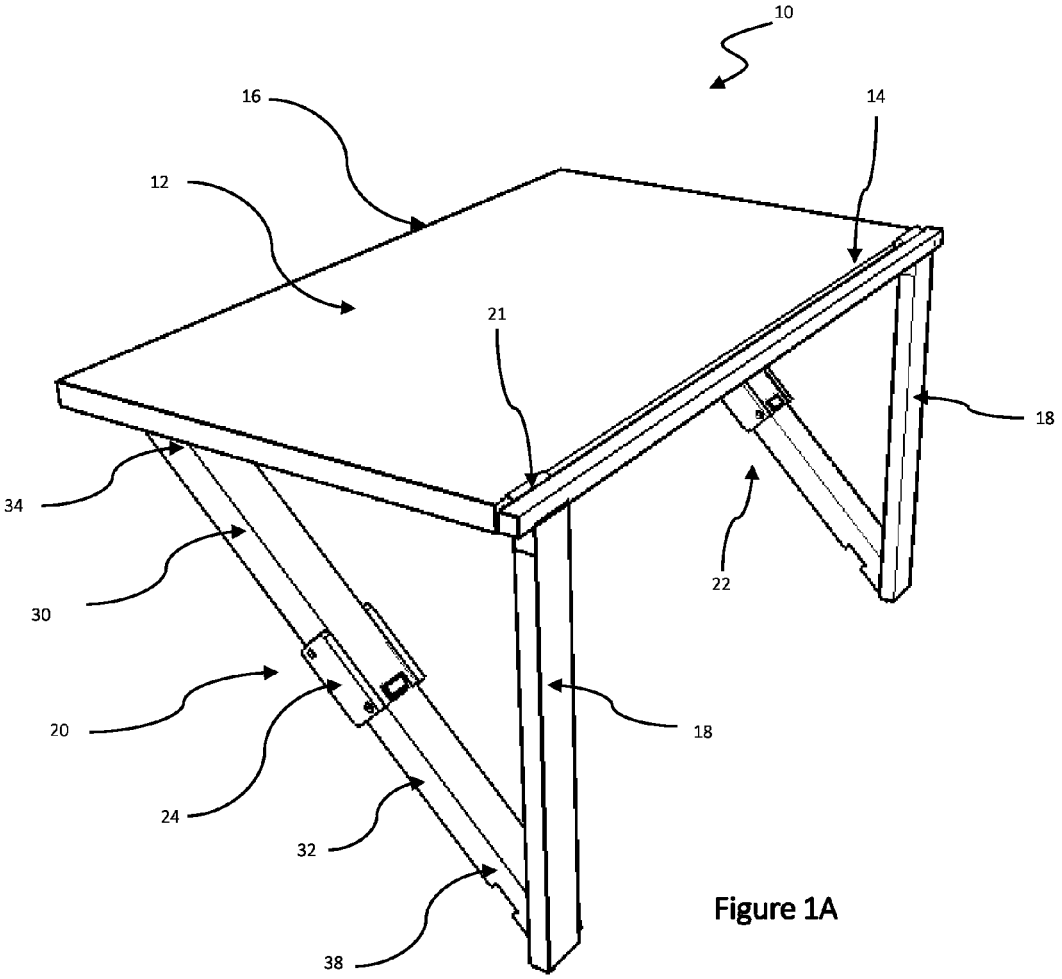
FIG. 1A is a rear perspective view of a wall mounted, collapsible table assembly in accordance with the present invention, depicting a table platform in a deployed position.
Figure 1B:
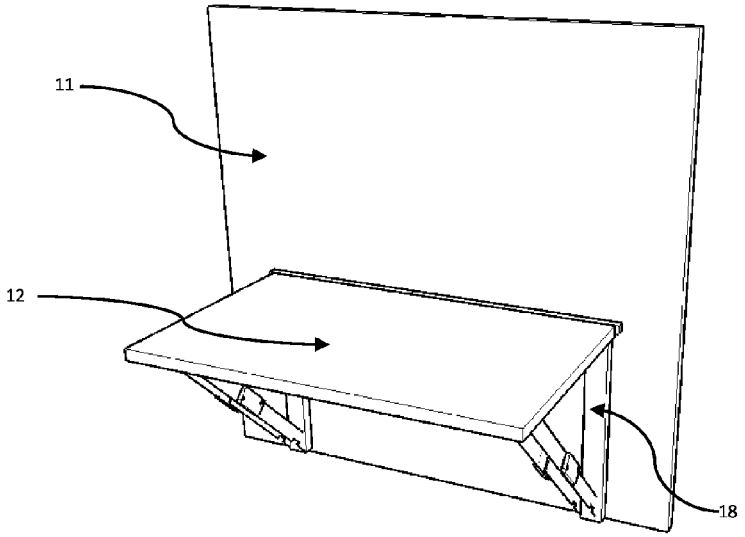
FIG. 1B is a front perspective view of a wall mounted, collapsible table assembly in accordance with the present invention, depicting a table platform in a deployed position.
Figure 1C:
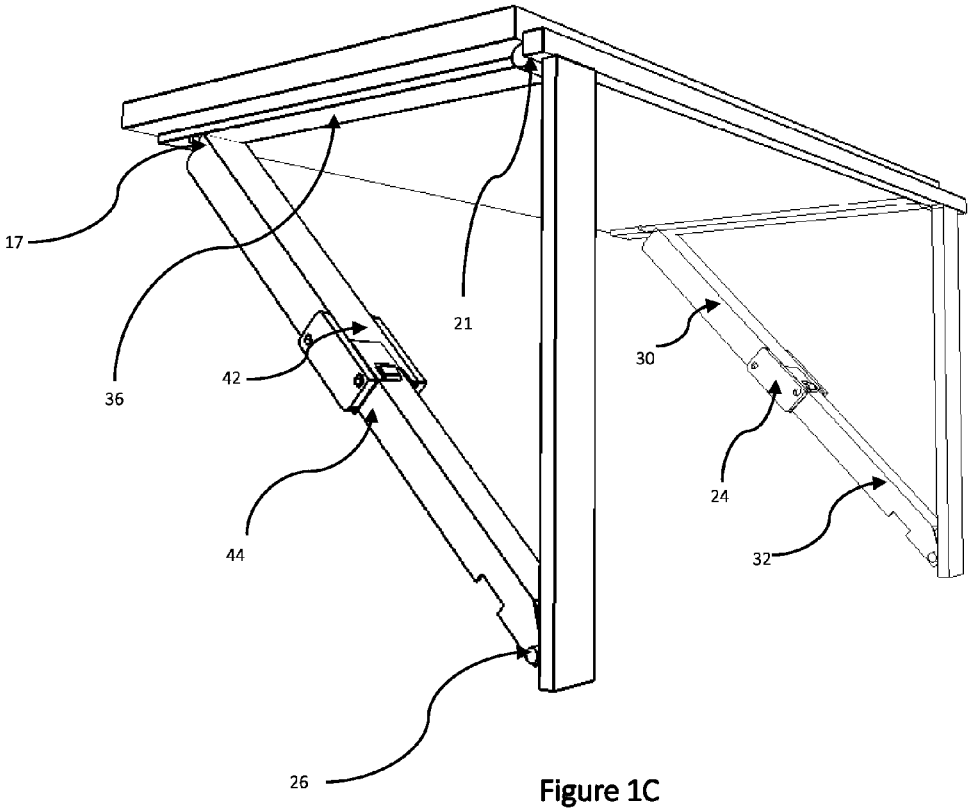
FIG. 1C is a rear, underneath, perspective view of a wall mounted, collapsible table assembly in accordance with the present invention, depicting a table platform in a deployed position.

Referring now to the drawings, and particularly FIGS. 1A, 1B, and 1C, there is shown a wall-mounted table assembly 10 in the deployed position. The table assembly 10 includes a table platform 12 having a proximal end 14 and a distal end 16. The table platform 12 is supported by a wall support 18 at the proximal end 14 and by hinged support arms 20, 22 at the distal end 16. The hinged support arms 20, 22 are coupled to a platform support beam 36, which is secured to the underside of the table platform 12, and coupled to the wall support 18. The proximal end 37 of the platform support beam 36 is attached to the top end 19 of the wall support 18 by a hinge 21. The wall support 18 mounts the table platform 12 to the wall 11. The bottom portion of the wall support 18 is coupled to the hinged support arms 20, 22 by a hinge 26. A hinge assembly 24 is located at an intermediary position between the hinged support arms 20, 22. The hinged support arms 20, 22 are capable of guiding the table platform 12 from a stowed position, to a deployed position, and vice versa, in such a way as to minimize its profile when in storage and prevent inadvertent release of the support arms 20, 22 when deployed.

With continued reference to FIGS. 1A-C, the hinged support arms 20, 22 each have a first segment 30 and a second segment 32. The top end 34 of the first segment 30 is hingedly coupled to the platform support beam 36, spaced apart from the proximate end 14 of the table platform 12. The bottom end 38 of the second segment 32 is hingedly coupled to the lower end 40 of the wall support 18. The bottom end 42 of the first segment 30 and the top end 44 of the second segment 32 are pivotably coupled by the hinge assembly 24, which is disposed at an intermediate location.

In the exemplary embodiment, when the table platform 12 is in the deployed position, the table platform 12 is perpendicular to the wall 11 and the hinged support arms 20, 22 extend from the wall support 18 to the platform support beam 36, with the first segment 30 and the second segment 32 aligned. In other embodiments, the table platform 12 can be deployed at varying degrees relative to the wall 11. In the exemplary embodiment, the first 30 and the second 32 segments are aligned parallel to each other with a reference angle of zero degrees. In other embodiments, the reference angle can vary without departing from the invention.

Figure 2A:
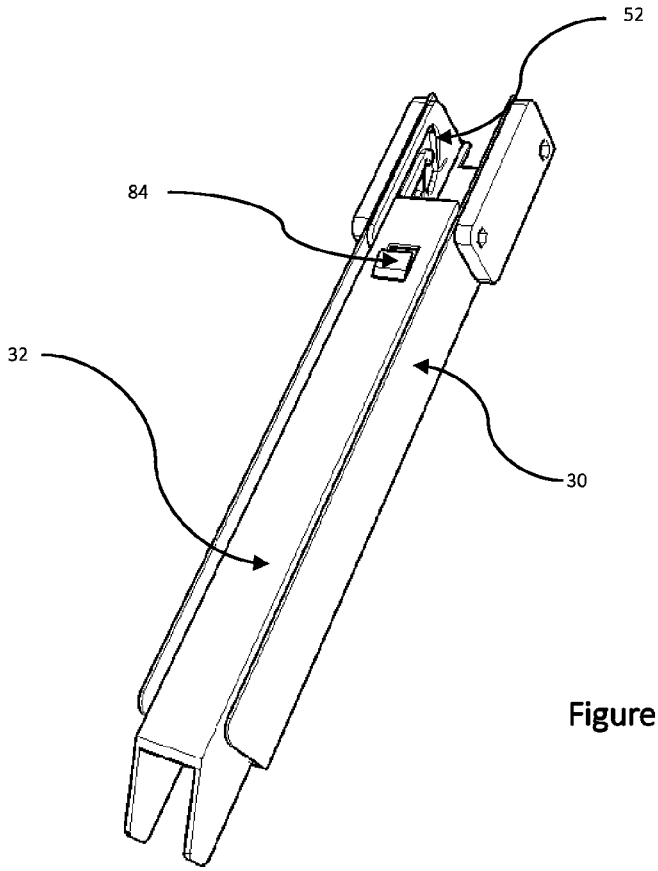
FIGS. 2A & 2B depict the position of the support arms when the collapsible table assembly is in the stowed position, and when it is in transition between stowed and deployed, respectively.
Figure 2B:
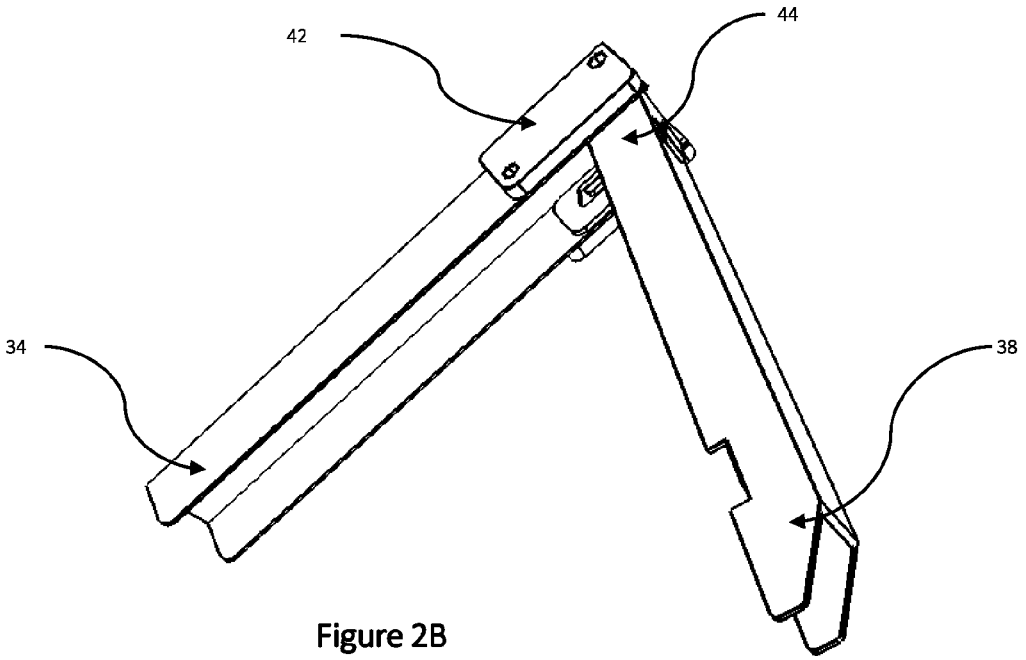

As best seen in FIGS. 2A-B, the first segment 30 and the second segment 32 are tubular, having U-shaped cross-sections. The second segment 32 is slightly smaller than the first segment 30, such that the second segment 32 fits within the first segment 30. This allows the support arms 20, 22 and the table platform 12 to be folded against the wall 11 when in the stowed position.

Figure 3A:
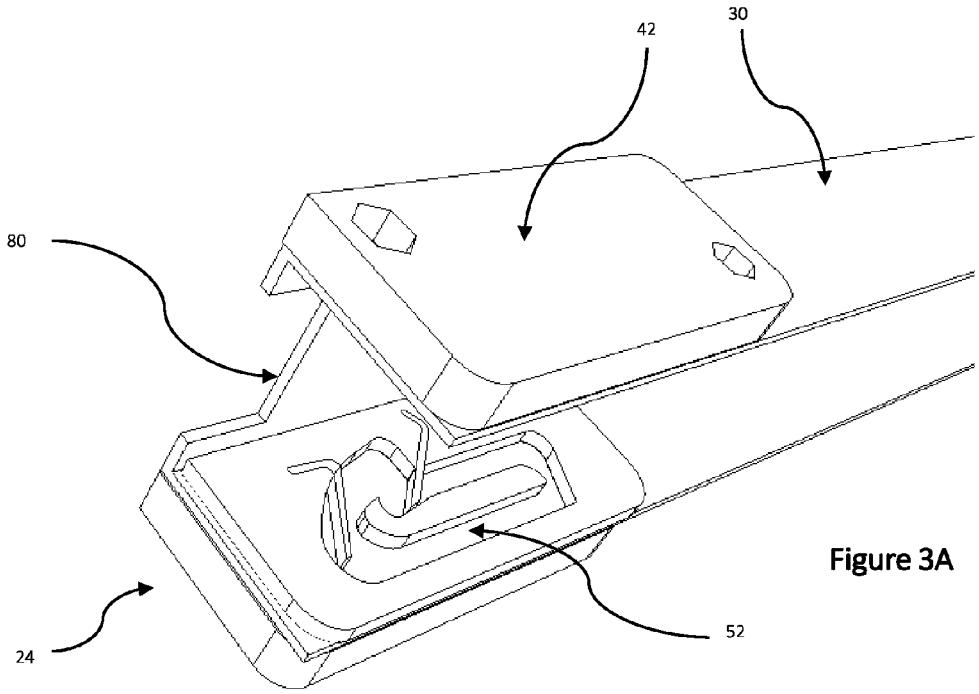
FIGS. 3A & 3B depict the guide groove and the hinge axis pin, respectively, in accordance with the present invention.
Figure 3B:
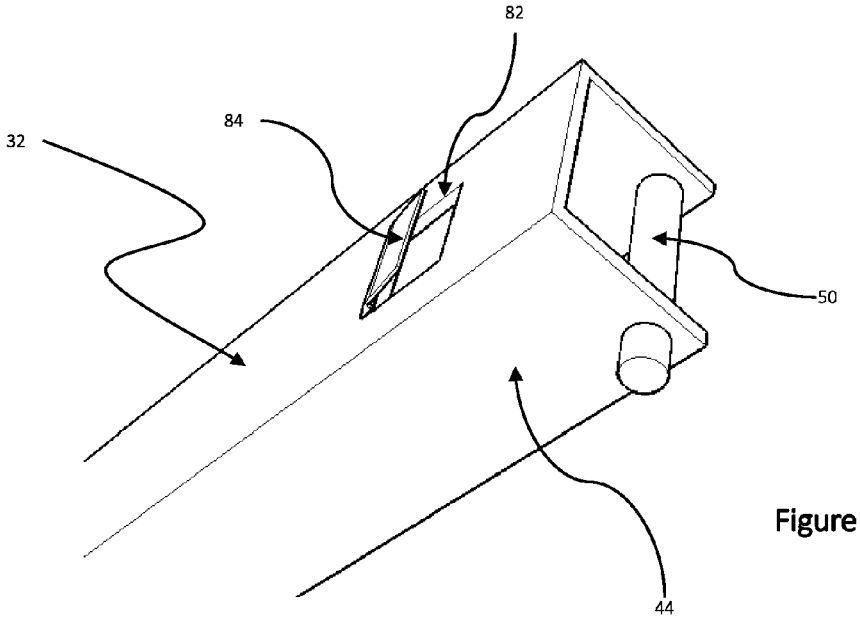

As depicted in FIGS. 3A-B, the hinge assembly 24 pivotably couples the first and second segments 30, 32 via a hinge axis pin 50 that is interconnected with a guide groove 52. The hinge axis pin 50 is integral with the top end 44 of the second segment 32, and extends outwards on each side to engage with the guide groove 52 defined within the sides at the bottom end 42 of the first segment 30.

With further reference to FIGS. 3A-B, the first segment 30 has a snap member 80 disposed at the bottom end 42. The snap member 80 is defined by a rectangular cutout from the bottom end wall 42. The second segment 32 has a snap connector 82 disposed near its top end 44. The snap connector 82 is defined by a rectangular cutout in the central portion of the top end 44, with a flanged-lip 84 that extends from the second segment 32 at an angle. The snap member 80 engages with the snap connector 82 when the table platform 12 is in the deployed position, with the flanged lip 84 of the snap connector 82 engaged with the cutout of the snap member 80 of the first segment 30.

Figure 4:
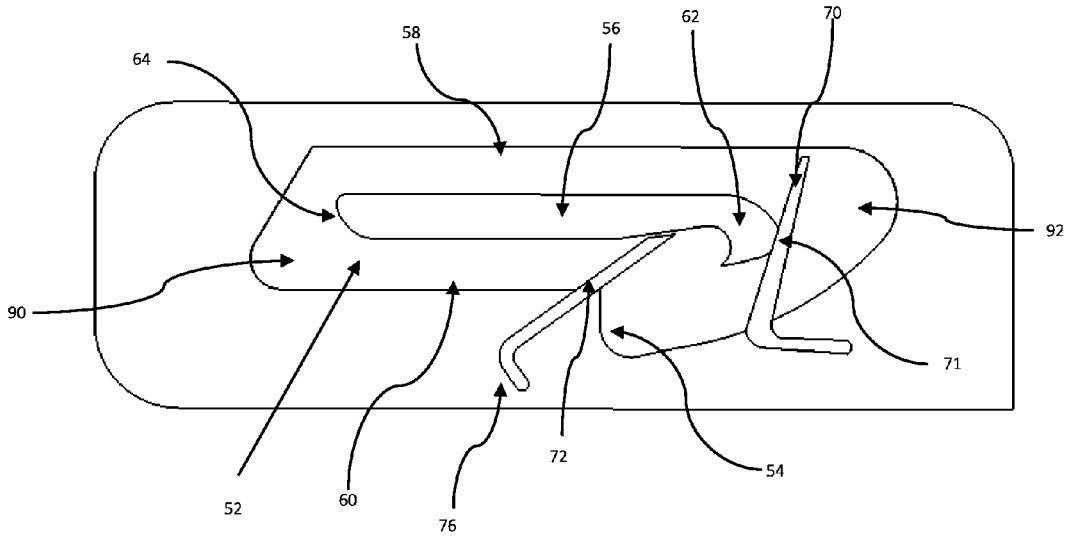
FIG. 4 is a planar view of the guide groove and pliant members, in accordance with the present invention.

With reference now to FIG. 4, the guide groove 52 is generally oval in shape, except where the stopper groove 54 is located. The guide groove 52 is defined by a recessed portion on each side of the first segment's 30 opposite walls. The central area of the recession has a raised guide member 56, which defines a path through which the hinge axis pin 50 may traverse. The raised guide member has a head portion 62 and a foot portion 64. The path consists of an upper hallway 58 and a lower hallway 60. The guide groove 52 is designed to receive the extended portion of the hinge axis pin 50, and allow the hinge axis pin 50 to traverse through the path defined by the guide groove 52 and the guide member 56.

Referring further to FIG. 4, two separate pliant members 70, 72 are shown disposed within the guide groove 52 to restrict certain directional travel by the hinge axis pin 50. The first pliant member 70 is anchored within the guide groove wall 74, extending across the guide groove 52 in a manner sufficient to allow the hinge axis pin 50 to travel in only one direction through the guide groove 52. The intermediate portion 71 of the first pliant member 70 abuts the head portion 62 of the guide member 56 within the guide groove 52. The second pliant member 72 is anchored within the guide groove wall 76, proximate to the stopper groove 54. The second pliant member 72 extends toward the guide member 56 at an angle and length sufficient to allow access when the hinge axis pin 50 is traveling one direction past the second pliant member 72, but prevent access when traveling the other direction. The second pliant member 72 is positioned to prevent inadvertent disengagement of the hinged support arm 20 or 22 when the table platform 12 is in the deployed position.

Figure 5A:
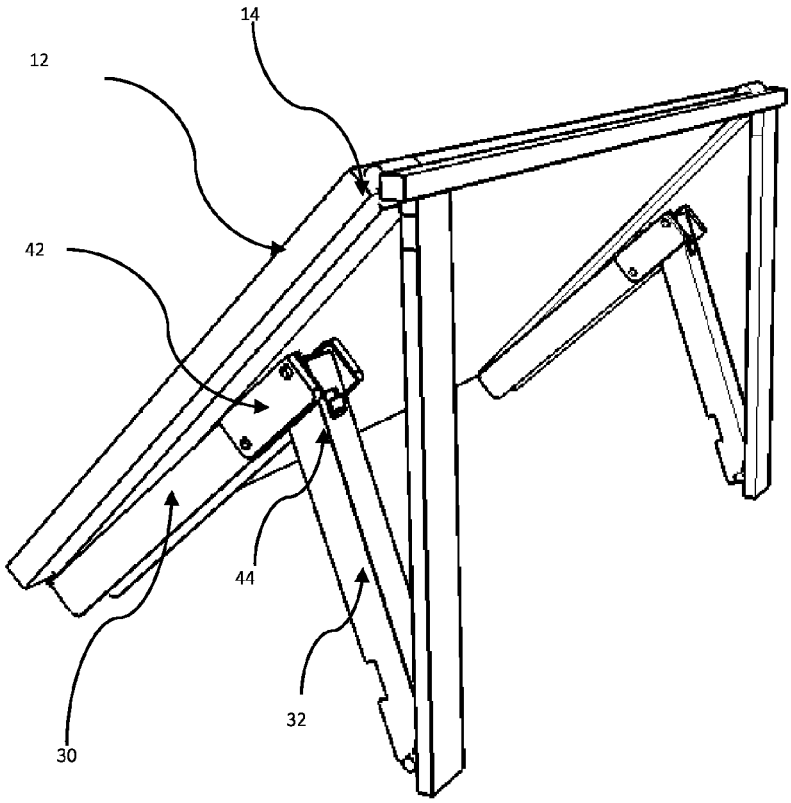
FIGS. 5A-B are an illustration of the path taken by the hinge axis pin through the guide groove as the table is transitioned between stowed and deployed, in accordance with the present invention.
Figure 5B:
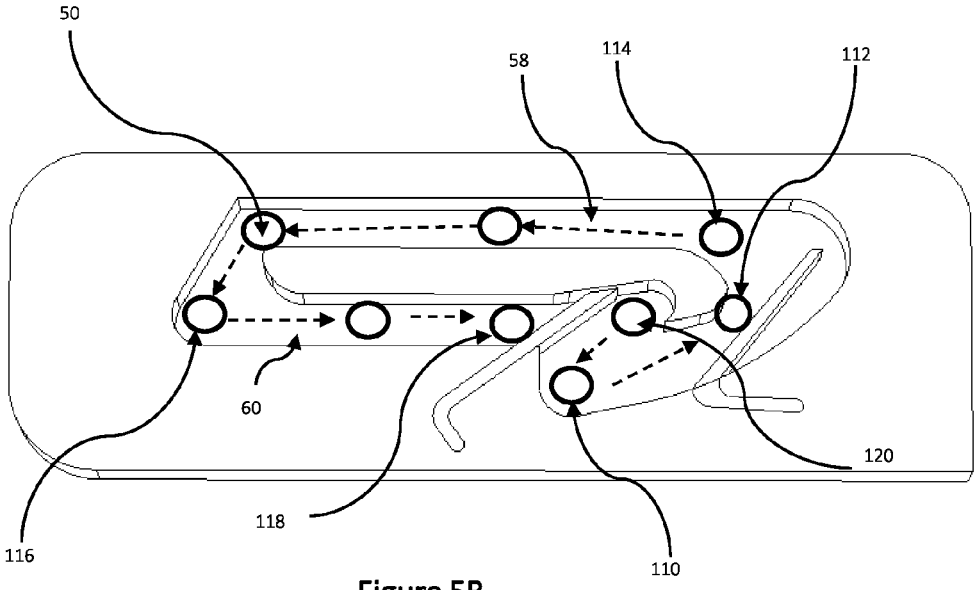

Referring now to FIGS. 5A-B, but with continued reference to FIG. 4, 5A shows the table platform 12 in a semi-collapsed state, and 5B depicts the location of the hinge axis pin 50 within the guide groove 52 as the table platform 12 is moved between its deployed and stowed position. In the deployed position, the first segment 30 is supported by the stopper groove 54 resting on the hinge axis pin 50. Additionally, the snap connector 82 and the snap member 80 are engaged to prevent the inadvertent buckling of the hinged support arm 20 or 22. When the hinge axis pin 50 is at the stopper groove 54 position within the guide groove 52, the second pliant member 72 and the head portion 62 of the guide member 56 prevent the hinge axis pin 50 from traversing to the bottom end 90 of the guide groove 54. This prevents the table platform 12 from collapsing if the hinge axis pin 50 is inadvertently dislodged from the stopper groove 54. The second pliant member 72 is important because if the hinge axis pin 50 is inadvertently dislodged, gravity will cause the hinge axis pin 50 to travel toward the bottom end 90 of the guide groove 54, which would essentially release the hinged support arms 20, 22, causing the table platform to collapse. While the second pliant member 72 prevents the hinge axis pin 50 from traveling this particular direction, the second pliant member 72 allows the hinge axis pin 50 to pass through when its direction of movement is towards the head portion 62 of the guide member 56 and the stopper groove 54.

With continued reference to FIG. 4, but particular reference to FIGS. 5A-B, the path of the hinge axis pin 50 is depicted with reference to its position when the wall mounted table assembly 10 is transitioned between the deployed state and the stowed state. When converting the table platform 12 from its deployed position to the stowed position, the user lifts up on the distal end 16 of the table platform 12. At position 110, the hinge axis pin 50 travels from the stopper groove 54 toward the first pliant member 70, around the outside of the head portion 62 of the guide member 56 at position 112. The first pliant member 70 will bend once a certain force threshold is met in order to allow the hinge axis pin 50 to traverse around the head portion 62 of the guide member 56 and into the upper hallway 58 the guide groove 52 at position 114. The first pliant member 70 prevents inadvertent release of the platform from the deployed position by requiring a certain amount of force to be applied when the user lifts up on the platform. This threshold is met when the first 30 and second 32 segments have substantially folded upon each other, and the table platform 12 is nearly parallel to the wall. When this occurs, the first pliant member 70 bends to allow the hinge axis pin 50 to traverse around the head portion 62 of the guide member 56 and through the upper hallway 58 of the guide groove 52. By allowing the hinge axis pin 50 to change locations, the second segment 32 becomes completely flush within the first segment 11.

Upon reaching the first pliant member 70, the first segment 30 and the second segment 32 pivot from their parallel support position, disengaging the snap connector 82 and snap member 80, and bending at the hinge axis pin 50 inward towards the proximate end 14 of the table platform 12. As the table platform 12 is lowered from being perpendicular to the wall 11, to being parallel with the wall 11, the hollow portion of the first segment 30 receives the second segment 32 as both segments 30, 32 pivot about the hinge axis pin 50, at position 114 and come to rest at roughly one-hundred and eighty degrees relative to the original zero degree relationship, at position 116.

With continued reference to FIGS. 5A-B, when moving the platform from the stowed position to the deployed position, the user just lifts the table platform 12 from the distal end 16. While the user is lifting the table platform 12, the first segment 30 and the second segment 32 pivot about the hinge axis pin 50. The hinge axis pin 50 travels from the bottom end 90 of the guide groove 52, at position 116, along the lower hallway 60 until it reaches the second pliant member 72, at position 118. Upon reaching the second pliant member 72, when sufficient force is applied, the second pliant member 72 will bend to allow the hinge axis pin 50 to pass through into the stopper groove 54 area, at position 120. The head portion 62 of the guide member 56 ensures that the hinge axis pin 50 returns to the stopper groove 54 after traversing through the second pliant member 72. Once the first segment 30 and the second segment 32 are parallel to each other, the hinge axis pin 50 is guided to the stopper groove 54, at position 110, and the snap member 80 and snap connector 82 engage.

Figure 6A:
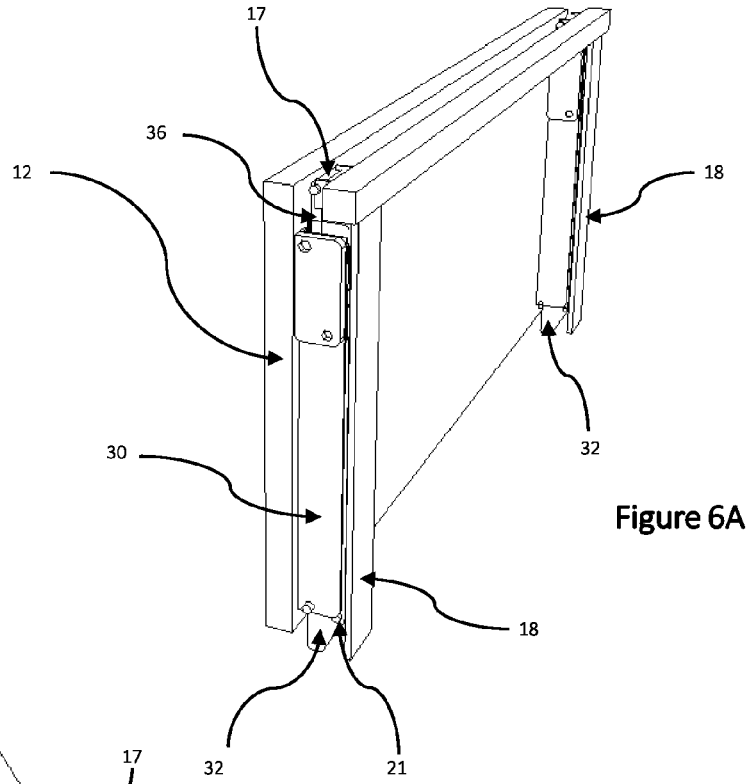
FIGS. 6A-B depict the collapsible table assembly in the stowed position, in accordance with the present invention.
Figure 6B:
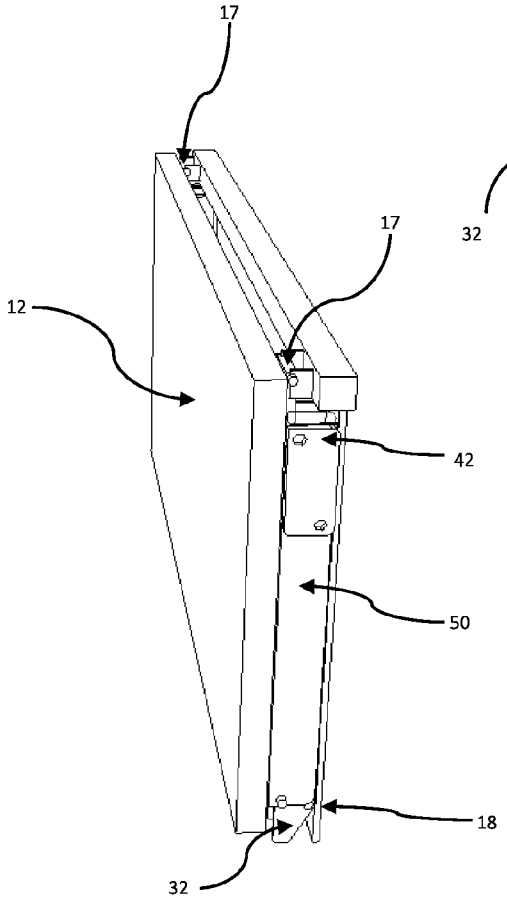

With reference now to FIGS. 6A and 6B, and continued reference to FIGS. 5A and 5B, when the table platform 12 is in the stowed position (parallel to the wall), the second segment 32 is fully encased within the first segment 30. The bottom end 42 of the first segment 30, the top end 44 of the second segment 32, and the hinge axis pin 50 come to rest proximate to the proximal end 14 of the table platform 12. The hinge axis pin 50 is engaged at the bottom end 90 of the guide groove 52, at position 116 and supports the weight of the table platform 12 that is transferred through the hinged support arm 50 in the stowed position. The wall support 18 absorbs this force at its lower end 40 via the hinge connector 21, and the platform support beam 36 holds the weight of the table platform 12 and transfers it to the wall 11 through the hinge connector 17 at the top end 34 of the first segment 30, through the hinge axis pin 50 engaged with the top end 92 of the guide groove 52, through the bottom end 38 of the second segment 32 which transfers the force to the wall support 18.

It should be appreciated from the foregoing that the present invention provides a collapsible table having a hinged interlocking assembly comprising support arms coupled to a table platform. The support arms are capable of guiding the platform from a stowed position, to a deployed position, and vice versa, in such a way as to minimize its profile when in storage and prevent inadvertent release of the support arms when deployed.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A collapsible table assembly comprising:

a table platform having a proximal end and a distal end mounted for rotation between a deployed position and a stowed position;

a wall support pivotally coupled to the proximal end of the table platform that mounts to a wall structure;

a hinged support arm for supporting the table platform having a first segment having a top end and a bottom end, the top end attaches to the table platform spaced apart from the proximal end of the table platform, a second segment having a top end and a bottom end, the bottom end of the second segment coupled to a wall structure below the table platform, and the top end of the second segment coupled to the bottom end of the first segment;

a hinge assembly disposed in an intermediate region of the hinged support arm that pivotally couples the first segment and the second segment together, the hinge assembly includes, a hinge axis pin that retains the first segment and the second segment together;

a guide groove defined by either the first segment or the second segment that confines the hinge axis pin within a closed path having a stopper groove;

a plurality of pliant members, including a first pliant member and a second pliant member disposed within the guide groove to restrict certain directional movement of the hinge axis pin as it traverses about the closed path when the table platform is moved between the stowed and the deployed positions, the first pliant member extending across the guide groove in a manner at an angle sufficient to allow the hinge axis pin to bend the first pliant member when approaching from a first side, and also sufficient to prevent the hinge axis pin from bending the first pliant member when as approaching from an opposite side, thereby allowing the hinge axis pin to travel in only one direction through the guide groove;

the second pliant member disposed proximate to the stopper groove, extending across the guide groove at a sufficient angle and of sufficient length to allow the hinge axis pin to travel one direction, but prevent the hinge axis pin from traveling the other direction; the second pliant member being sufficiently pliant to bend when the hinge axis pin contacts the second pliant member from one side, yet sufficiently angled relative to the guide groove to not bend when the hinge axis pin contacts the second pliant member from the opposite side, such that the second pliant member prevents inadvertent disengagement of the hinged support arm when the table platform is in the deployed position, by restricting the hinge axis pin to pass only when transitioning the table platform into the deployed position;

when the table platform is in the deployed position, the platform is supported by the hinge axis pin resting on the stopper groove; when the table platform is in the stowed position, the table platform is supported by the hinge axis pin resting at the bottom end of the guide groove.

2. The collapsible table assembly as defined in claim 1, wherein the first and second segments are tubular, U-shaped, cross-sections such that the first segment rests within the second segment when the platform is collapsed into the stowed position.

3. The collapsible table assembly as defined in claim 1, wherein the guide member of the guide groove is solid.

4. The collapsible table assembly as defined in claim 1, wherein the guide member of the guide groove comprises multiple, separate portions, spaced to confine the hinge axis pin to the guide groove.

5. The collapsible table assembly as defined in claim 1, wherein two or more hinged support arms are employed.

6. The collapsible table assembly as defined in claim 1, wherein the first pliant member extends across the guide groove, having an intermediate portion of the first pliant member contacting the guide member.

7. The collapsible table assembly as defined in claim 1, wherein the first pliant member extends across the guide groove, having an intermediate portion of the first pliant member spaced apart from the guide member.

8. The collapsible table assembly as defined in claim 1, wherein the second pliant member extends across the guide groove at an angle between zero degrees and ninety degrees relative to the guide groove wall.

9. The collapsible table assembly as defined in claim 8, wherein the second pliant member extends across the guide groove, having a length sufficient to contact the guide member.

10. The collapsible table assembly as defined in claim 8, wherein the second pliant member extends across the guide groove, but does not contact the guide member.

11. A collapsible table assembly, comprising:

a table platform having a proximal end and a distal end mounted for rotation between a deployed position and a stowed position; a wall support pivotally coupled to the proximal end of the table platform and that mounts to a wall structure; a hinged support arm having a first segment having a top end and a bottom end, the top end attaches to the table platform spaced apart from the proximal end of the table platform, a second segment having a top end and a bottom end, the bottom end coupled to the wall structure below the table platform, and the top end coupled to the bottom end of the first segment;

a hinge assembly disposed in an intermediate region of the hinged support arm that pivotally couples the first segment and the second segment together, the hinge assembly includes, a hinge axis pin that retains the first segment and the second segment together;

a guide groove defined by either the first segment or the second segment that confines the hinge axis pin within a closed path having a stopper groove;

a plurality of pliant members, including a first pliant member and a second pliant member disposed within the guide groove to restrict certain directional movement of the hinge axis pin as it traverses around the guide member when the table platform is moved between the stowed and deployed positions;

the first pliant member anchored within the guide groove wall, extending across the guide groove at an angle sufficient to allow the hinge axis pin to bend the first pliant member when approaching from a first side, and also sufficient to prevent the hinge axis pin from bending the first pliant member when approaching from an opposite side thereby allowing the hinge axis pin to travel in only one direction through the guide groove;

the second pliant member anchored within the guide groove wall proximate to the stopper groove, extending towards the guide member at a sufficient angle and sufficient length to allow access when the hinge axis pin is traveling one direction, but prevent access when traveling the other direction the second pliant member being sufficiently pliant to bend when the hinge axis pin contacts the second pliant member from one side, yet sufficiently angled relative to the guide groove to not bend when the hinge axis pin contacts the second pliant member from the opposite side, such that the second pliant member prevents inadvertent disengagement of the hinged support arm when the table platform is in the deployed position, by restricting the hinge axis pin to pass only when bringing the table platform into the deployed position;

the first segment further having a snap member disposed near the bottom end;

the second segment further having a snap connector disposed at the top end;

when the table platform is in the deployed position, the platform is supported by the hinge axis pin resting on the stopper groove, with the snap member and the snap connector engaged to reinforce the hinge assembly;

when the table platform is in the stowed position, the table platform is supported by the hinge axis pin resting on the guide groove wall.

12. The collapsible table assembly as defined in claim 11, wherein the first and second segments are tubular, U-shaped, cross-sections such that the first segment rests within the second segment when the platform is collapsed into the stowed position.

13. The collapsible table assembly as defined in claim 11, wherein the guide member of the guide groove is solid.

14. The collapsible table assembly as defined in claim 11, wherein the guide member of the guide groove comprises multiple, separate portions, spaced to confine the hinge axis pin to the guide groove.

15. The collapsible table assembly as defined in claim 11, wherein two or more hinged support arms are employed.

16. The collapsible table assembly as defined in claim 11, wherein the first pliant member extends across the guide groove, having an intermediate portion of the first pliant member contacting the guide member.

17. A collapsible table assembly comprising:

a table platform having a proximal end and a distal end, the proximal end of the table platform coupled to a wall structure for rotation between a deployed position and a stowed position; and a hinged support arm for supporting the table platform having a first segment coupled to the table platform and a second segment coupled to a wall structure below the table platform, and the top end of the second segment coupled to the bottom end of the first segment wherein the first segment is coupled to the second segment via a hinge assembly, the hinge assembly includes:

a hinge axis pin that retains the first segment and the second segment together;

a guide groove defined by either the first segment or the second segment that confines the hinge axis pin within a closed path having a stopper groove;

a plurality of pliant members, including a first pliant member and a second pliant member disposed within the guide groove to restrict certain directional movement of the hinge axis pin as it traverses past each pliant member when the table platform is moved between the stowed and the deployed positions, the first pliant member anchored within the guide groove wall, extending across the guide groove at an angle sufficient to allow the hinge axis pin to bend the first pliant member when approaching from a first side, and also sufficient to prevent the hinge axis pin from bending the first pliant member when approaching from an opposite side thereby allowing the hinge axis pin to travel in only one direction through the guide groove;

the second pliant member anchored within the guide groove wall proximate to the stopper groove, extending towards the guide member at a sufficient angle and sufficient length to allow access when the hinge axis pin is traveling one direction, but prevent access when traveling the other direction the second pliant member being sufficiently pliant to bend when the hinge axis pin contacts the second pliant member from one side, yet sufficiently angled relative to the guide groove to not bend when the hinge axis pin contacts the second pliant member from the opposite side, such that the second pliant member prevents inadvertent disengagement of the hinged support arm when the table platform is in the deployed position, by restricting the hinge axis pin to pass only when bringing the table platform into the deployed position;

when the table platform is in the deployed position, the platform is supported by the first and second segments extended; when the table platform is in the stowed position, the table platform is supported by the first and second segments being folded.

18. The collapsible table assembly as defined in claim 17 wherein the second pliant member extends across the guide groove at an angle between zero degrees and ninety degrees relative to the guide groove wall.

19. The collapsible table assembly as defined in claim 18, wherein the first pliant member extends across the guide groove, having an intermediate portion of the first pliant member contacting the guide member.

20. The collapsible table assembly as defined in claim 17, wherein the guide member of the guide groove comprises multiple, separate portions, spaced to confine the hinge axis pin to the guide groove.

* * * * *